US008210874B2

(12) United States Patent
Zhang et al.

(10) Patent No.: US 8,210,874 B2
(45) Date of Patent: Jul. 3, 2012

(54) COMBO ELECTRICAL CONNECTOR

(75) Inventors: George Huanyi Zhang, Irvine, CA (US); Hong-Jing Luo, Shenzhen (CN); Bin Pan, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/891,825

(22) Filed: Sep. 28, 2010

(65) Prior Publication Data

US 2012/0077379 A1 Mar. 29, 2012

(51) Int. Cl.
*H01R 24/00* (2006.01)

(52) U.S. Cl. ..... 439/607.01

(58) Field of Classification Search ..... 439/607.01, 439/660, 637; D3/147
See application file for complete search history.

(56) References Cited

U.S. PATENT DOCUMENTS

| | | | | |
|---|---|---|---|---|
| D469,407 | S * | 1/2003 | Wu | D13/147 |
| 6,832,934 | B1 * | 12/2004 | Zhang | 439/660 |
| 6,887,098 | B1 * | 5/2005 | Luo et al. | 439/540.1 |
| 6,908,330 | B2 * | 6/2005 | Garrett et al. | 439/378 |
| 7,497,709 | B1 * | 3/2009 | Zhang | 439/188 |

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector assembly includes a first and a second electrical connector each having two connector ports. The first connector port of the first connector has an insulating mating tongue with a plurality of contacts thereon and an insulating protecting frame arranged side by side with the mating tongue along a longitudinal direction of the first connector and spaced away from the mating tongue. The second connector port is received in the protecting frame and has a shielding shell surrounding therearound.

9 Claims, 6 Drawing Sheets

COMBO ELECTRICAL CONNECTOR

CROSS-REFERENCE TO RELATED APPLICATION

This application is related to a prior patent application which is filed on Apr. 1, 2010, application Ser. No. 12/752,442 and entitled "COMBO ELECTRICAL CONNECTOR". The inventors of the prior patent application are two of three inventors herein. The two applications will assign to a same assigner, Hon Hai Precision IND CO., LTD.

BACKGROUND OF THE INVENTION

1. Field of the Invention

The present invention relates to an electrical connector having a plurality of connector ports arranged side by side, and particularly to a USB port and a power port.

2. Description of Related Arts

Recently, personal computers (PC) are used in a variety of techniques for providing input and output. Universal Serial Bus (USB) is a serial bus standard to the PC architecture with a focus on computer telephony port, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

With the requirement of data transmission speed is higher and higher, the speed of a USB 2.0 plug is insufficient to support high-speed transmission between external devices. Therefore the USB specification is developed at a higher version of USB 3.0. A standard USB 3.0 accelerating data transmission to 4.8 Gbps, is designed to be backwards-compatible with USB 2.0.

The USB 3.0 Connectors and Cable Assemblies have three types, Type A, Type B, and Type Micro B receptacles, plugs and wire harness arrangement. Said three types of connectors, including plugs and receptacles, have different contour configuration, resulting in independent usage by themselves to certain extent. USB 3.0 type Micro B includes two mating interface separated from each other by a partition wall integrated with the shell. USB 3.0 Type Micro B as known so far will commonly be used in consumer electronic devices. So there is a hope to initiate a USB 3.0 Type Micro B carrying other interfaces which can be used in other applications.

Hence, a new electrical connector is desired.

SUMMARY OF THE INVENTION

An electrical connector assembly comprises a first electrical connector and a second electrical connector. The first electrical connector comprises a first connector port which has an insulating mating tongue with a plurality of contacts thereon, an insulating protecting frame arranged side by side with the mating tongue along a longitudinal direction of the first electrical connector and spaced away from the mating tongue and a second connector port receiving in the protecting frame. The first connector port has a shielding shell surrounding therearound. The electrical second connector mating with the first electrical connector, comprises a third connector port which has a mating slot to receive the mating tongue and a forth connector port to receive in the second connector port. The forth connector port has a shielding shell surrounding therearound.

Other advantages and novel features of the invention will become more apparent from the following detailed description of the present embodiment when taken in conjunction with the accompanying drawings

DETAILED DESCRIPTION OF THE PREFERRED EMBODIMENT

Figure 1:
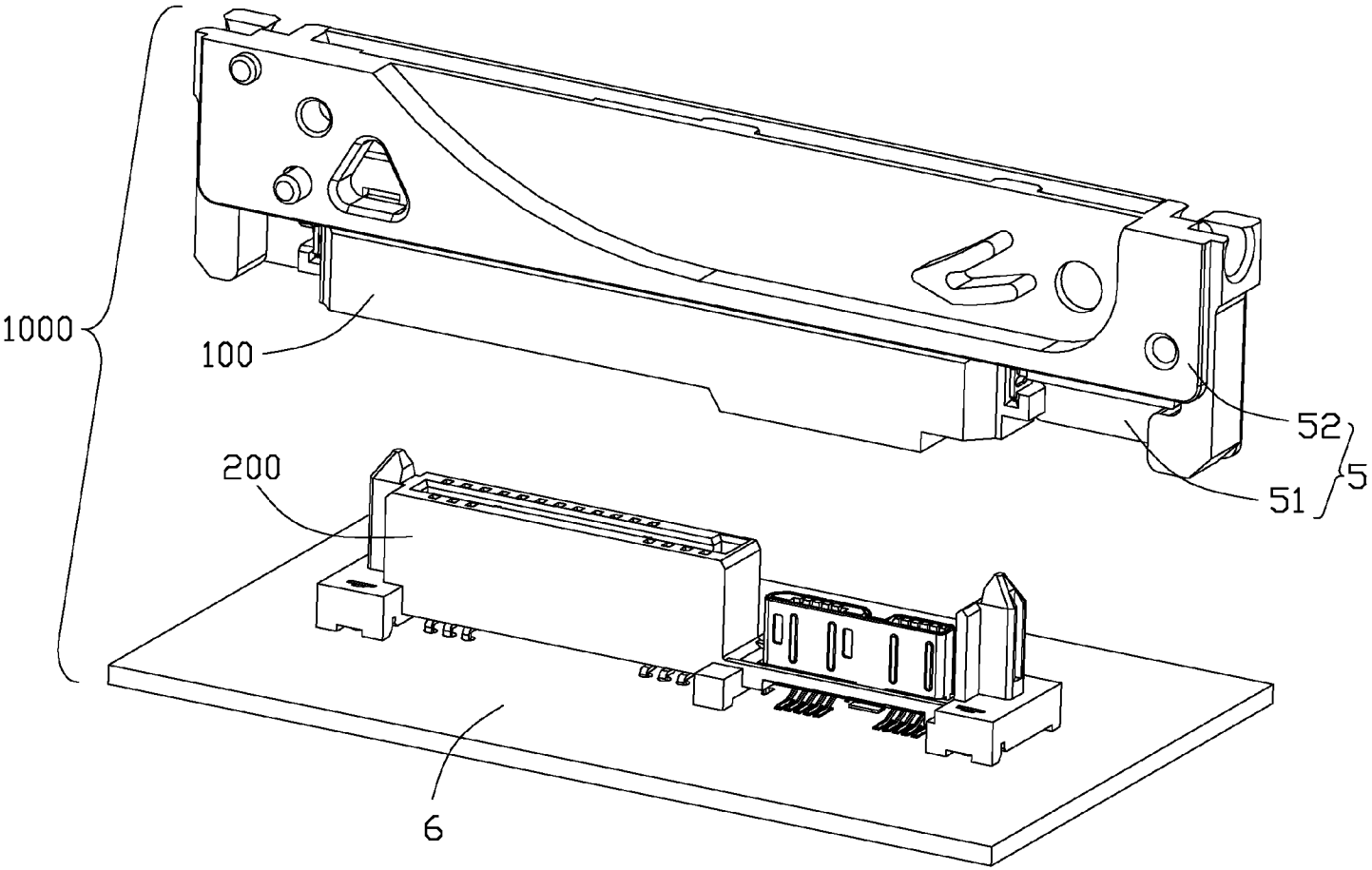
FIG. 1 is a perspective view of an electrical connecting system in accordance with the present invention, wherein two electrical connectors disconnect from each other.

Reference will be made to the drawing figures to describe the present invention in detail, wherein depicted elements are not necessarily shown to scale and wherein like or similar elements are designated by same or similar reference numeral through the several views and same or similar terminology.

Referring to FIG. 1 showing an electrical connecting system 1000, a first electrical connector 100 is equipped on a frame 5 of device equipments, such as HDD and a second electrical connector 200 adapted for mating with the first electrical connector 100 which is mounted on a printed circuit board 6 in backplane equipments such as servers (not shown).

Figure 2:
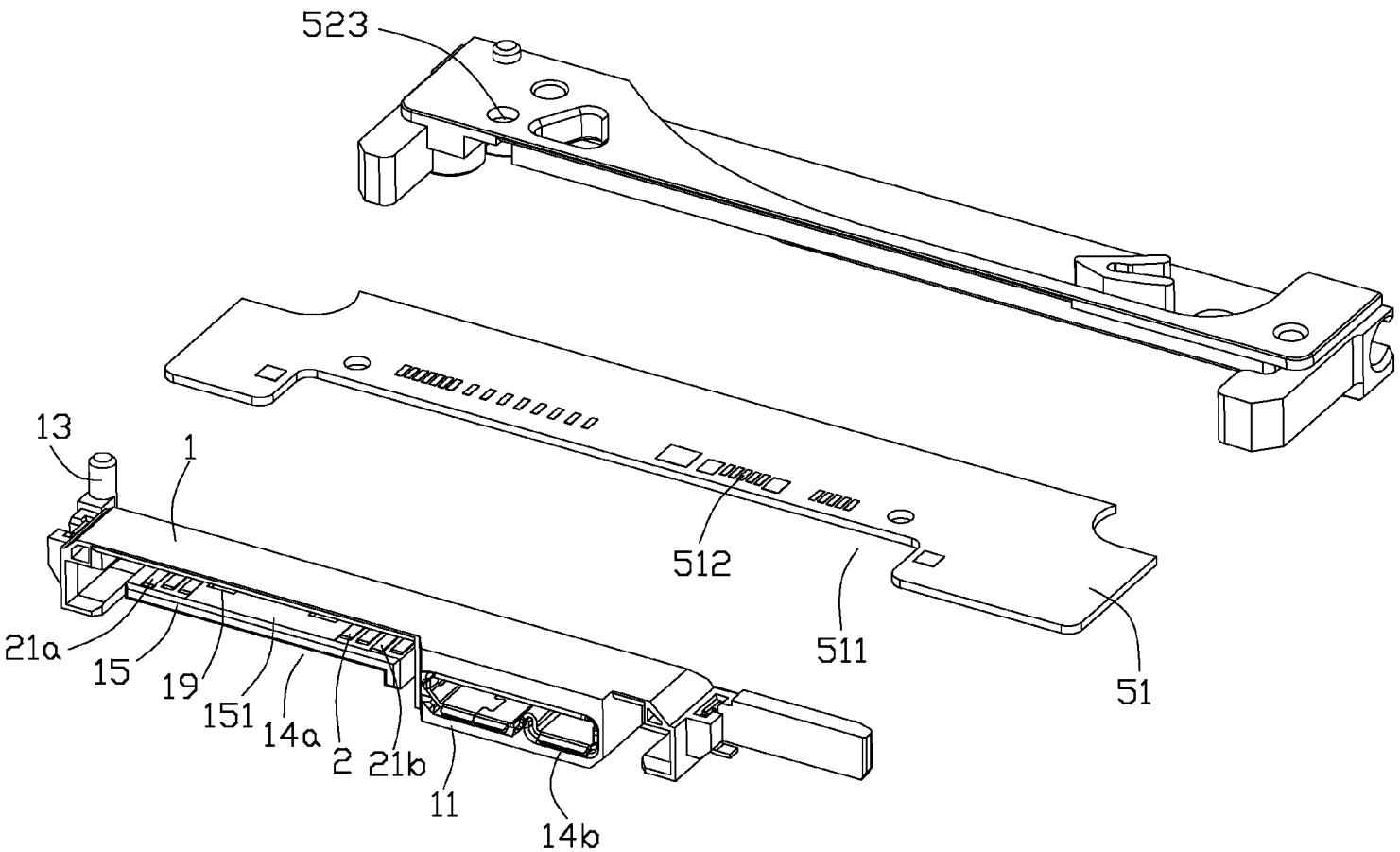
FIG. 2 is a perspective view of a first electrical connector, a frame and a printed circuit board.
Figure 3:
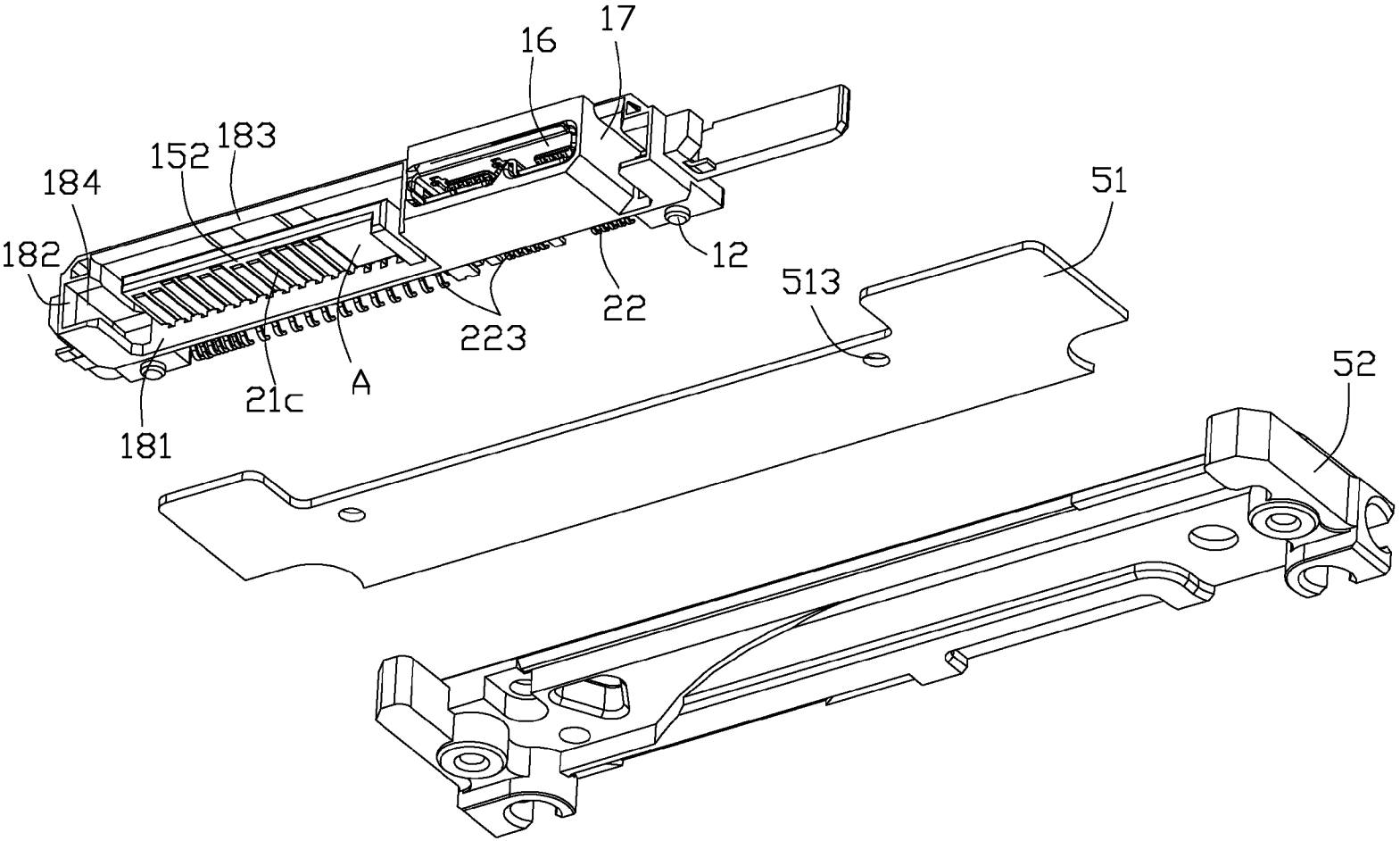
FIG. 3 is similar to FIG. 2 viewed from a different orientation.

As shown in FIGS. 2 and 3, the first electrical connector 100 has a longitudinal insulating housing 1 with a front mating edge 11 and a plurality of terminals 2 retained in the housing with soldering portions 223 extending to a rear face thereof. The first connector 100 is sunk in a notch 511 of a printed circuit board (PCB) 51 and the soldering portions 223 securely connects with the conductive pads 512 of the PCB 51 by a pair of posts 12 on a bottom face of the housing being inserted in a pair of through holes 513 of the PCB 51. A supporting frame 52 which is one portion of the device equipment is locked on a top of the first connector 100 which is on the PCB 41 by a post 13 on the top of the housing accommodating in the hole 523 so that the first connector 100 is assembled in the device equipment.

The first connector 100 includes two connector ports 14*a*, 14*b* which are defined to complete a functional electrical connection. The first connector port 14*a* includes a mating tongue 15 and three groups of contacts 21*a*, 21*b*, 21*c*, two groups of which are arranged along the longitudinal direction of housing on an upper surface 151 and one group of which are on a lower surface 152 of the tongue portion 15. The second connector port 14*b* is configured by a shielding shell 16 surrounding a plurality of contacts 22 to constitute the mating port. The first connector port 14*a* is adapted for power segment and the second connector port 14*b* is adapted for USB 3.0 Micro B type which is backward to a USB 2.0 Micro B type. The first connector 100 further include a protecting frame 17 which is arranged side by side with the mating tongue 15 along the longitudinal direction of the connector and spaced from the mating tongue 15 with a distance. The second connector port 14*b* is located in and supported by the protecting frame 17 since the inside of the protecting frame 17 conform to the outline of the second connector port 14*b*. Thus, the connector ports 14*a*, 14*b* are arranged side by side along the longitudinal direction of the first electrical connector.

The housing of the first connector 100 further includes a base/rear wall 181, two end walls 182 at two opposite ends of the base wall 181 and a side wall 183 jointed with said two end walls 182. The side wall 183 is located at the top side of the mating tongue 15 and the protecting frame 17, and the end walls 182 separate from the mating tongue 15 and the protecting frame 17. Each end wall 182 defines a guiding recess 184 opening forwards and inwards to face one ends of the mating tongue 15 and protecting frame 17. Said end walls 182, side wall 183, mating tongue 15 and protecting frame 171 integrally extend forwards from the base wall 181. The mating tongue 15 separates from the side wall 183 while the protecting frame 17 is unitary with the side wall 183.

Figure 6:
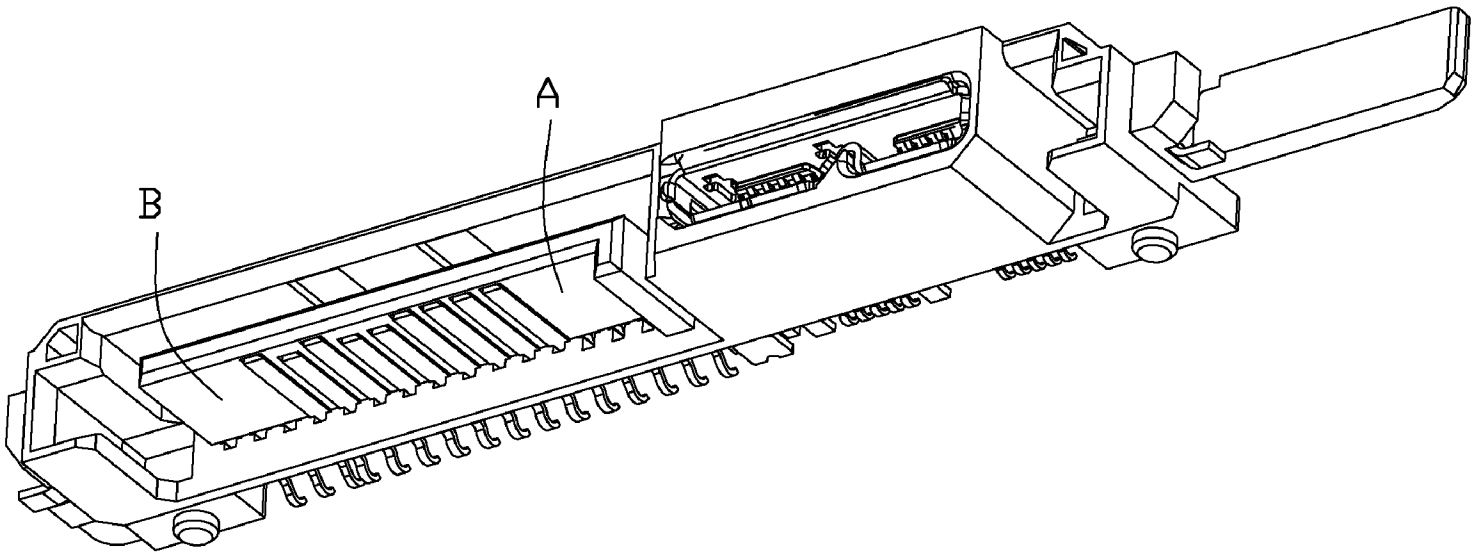
FIG. 6 is a perspective view of a first electrical connector of other embodiment.

Please notes, the first group 21*a* of the contacts and the second group 21*b* are disposed adjacent to opposite ends of the upper surface 151 or first surface of tongue portion 15 in the longitudinal direction, while the third group of contacts 21*c* have more contacts and are arranged at a middle portion and one end of the lower surface or the second surface 152 of the tongue portion 15. In other words, the lower surface 152 has an area portion A which is aligned with the second group 21*b* of contacts on the upper surface 151, without any contacts. Moreover, as shown in FIG. 6, another area portion B which is aligned with the first group 21*a* can also be provided without any contacts, i.e., three left most contacts are taken away to expose the another area portion B. Compared with conventional SATA power connector which has similar configuration with the tongue portion 15, three contacts conforming to 3V power pins are taken away to expose the area portion A in FIG. 3 and three contacts conforming to 12 V power pins are further taken away to expose the area portion B, which not only benefit the strength of the tongue portion 15, but also is backward compatible to SATA power connector. The upper surface 151 defines two retention slots 16 adjacent to said two groups respectively to stably lock with the second connector.

Figure 4:
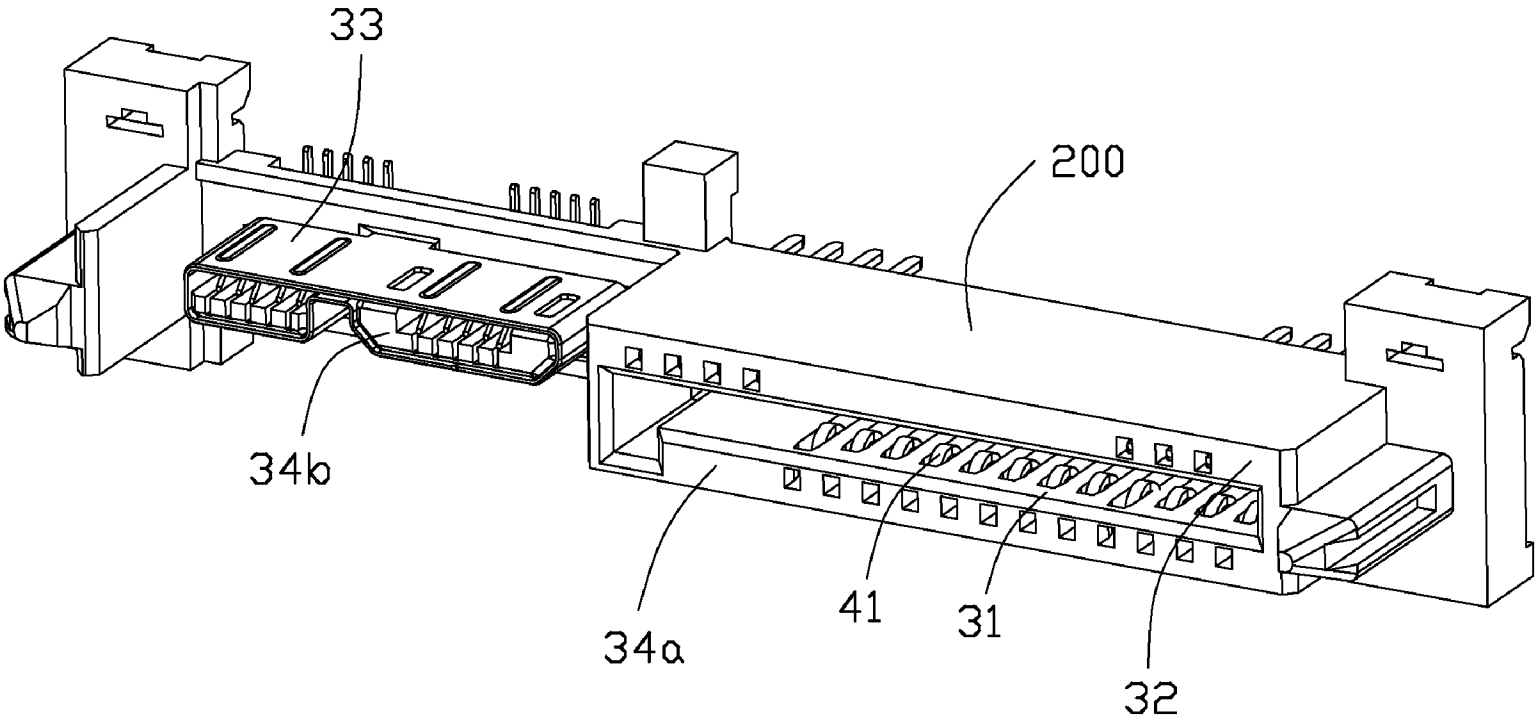
FIG. 4 is a perspective view of a second first electrical connector.

Referring to FIG. 4, the second electrical connector 200 of backplane connector type is adapted for mating with said first electrical connector 100. The second connector 200 has a third connector port 34*a* and a forth connector port 34*b* arranged side by side and spaced from each other along the longitudinal direction thereof. The third connector port 34*a* includes a forward opening inverted L shaped mating slot 31 surrounded by four side wall 32 and a plurality of contacts 41 exposed to the mating slot. The forth connector port 34*b* surrounds with a shielding shell 33 therearound.

Figure 5:
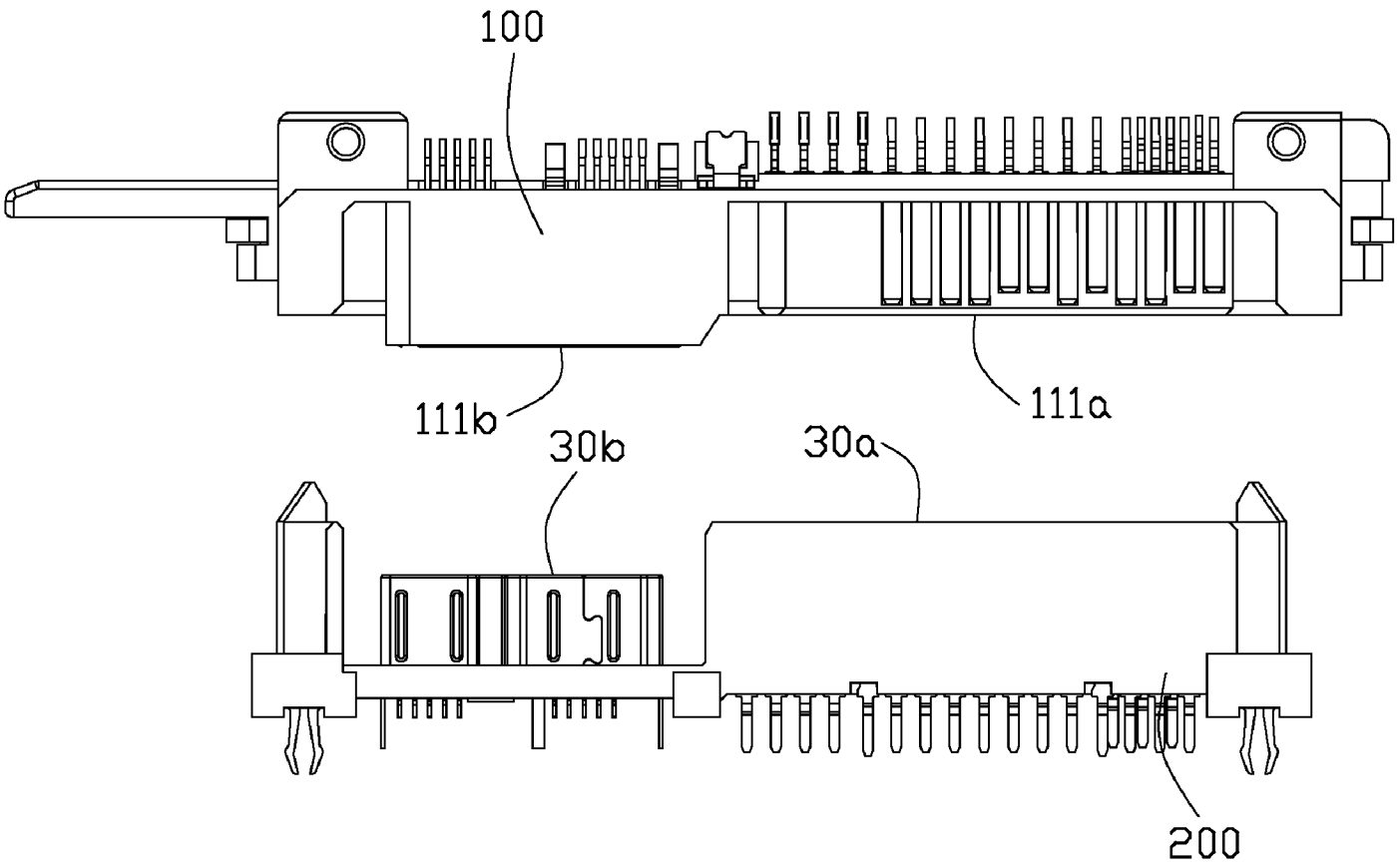
FIG. 5 is a from side view of the first and second electrical connectors intended to mate with each other.

FIG. 5 shows the rear side view of said electrical connectors intended to mate with each other. Combination with FIG. 2, each of said four connector ports has a front mating edge which may be one point, one line or one plane to be engaged with a corresponding connector port firstly. Said four front mating edges are designated as 111*a*, 111*b*, 30*a*, 30*b*. The second front mating edge 111*b* of the second connector port 14*b* projects forwards beyond the first front mating edge 111*a* of the first connector port 14*a* with a distance of a 1.3 mm in a best embodiment The. The third front edge 30*a* of the third connector port 34*a* projects forward relative to the forth front mating edge 30*b* of the forth connector port 34*b*.

Since the first connector 100 mounted on the device equipment is actively mated with the second connector 200 on the system equipment, the forward mating edge 111*b* benefit a first alignment of the first connector 100 to the second connector 200 and then an alignment of the whole connector. As a result, a facility and stable mating process obtains through said structure, especially the frame shaped of the second connector port 14*b*. Please notes that the name of the first through the forth is only for convenient description.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. An electrical connector comprising:

an elongated insulating housing defining a lengthwise direction and a mating direction perpendicular to said lengthwise direction;

a first connector port including two spaced tongue portions and a metallic shield inside a contour thereof to surround said two tongue portions, the tongue portions being equipped with a first group and a second group of contacts on a first face of the tongue portions respectively;

a second connector port located beside and separated from the first connector port in said lengthwise direction;

a front mating edge of the first connector port projects forwards than the that of the second connector port.

2. The electrical connector as claimed in claim 1, wherein the third group of the contacts are located between the first and second group of the contacts in the lengthwise direction.

3. The electrical connector as claimed in claim 1, wherein the second connector port further includes an insulating frame fitly surrounding the metallic shield.

4. An electrical connector assembly comprising:

a stationary first connector including:

a first elongated insulative housing defining a long mating section and a short mating section spaced from each other along a lengthwise direction, said long mating section being wider than the short mating section in a lateral direction perpendicular to said lengthwise direction, said long mating section forwardly protruding beyond the short mating section in a front-to-back direction perpendicular to both said lengthwise direction and said lateral direction;

a moveable second connector including:

a second elongated insulative housing defining a long mating portion and a short mating portion space from each other in the lengthwise direction, said long mating portion being wider than the short mating portion in the lateral direction, said short mating portion forwardly protruding beyond the long mating portion; whereby an offset arrangement of the long mating section and the short mating section of the first connector in said front-to-back, is essentially complementary with another offset arrangement of the long mating portion ad the short mating portion of the second connector in said front-to-back direction so as to obtain a balanced mating force during mating;

wherein said first connector is further equipped with a pair of guiding posts located at two opposite ends in said lengthwise direction, and said pair of guiding posts extend forwardly beyond both said long mating section and the short mating section in said front-to-back direction;

wherein the short mating section of the first connector is equipped with a metallic shell surrounding therewith and exposed to an exterior while the long mating section is not;

wherein the short mating portion of the second connector is equipped with a metallic shell inside a contour thereof to surround corresponding two spaced mating tongues while the long mating portion is not.

5. An electrical connector comprising:

an elongated insulative housing defining a long mating portion and a short mating portion spaced from each other in a lengthwise direction thereof, said longer mating portion forwardly protruding beyond the short mating portion in a mating direction perpendicular to the lengthwise direction;

wherein the short mating portion is configured with an insulating portion loaded with a plurality of terminals and a metallic shield snugly surrounding the insulating portion to commonly define a mating cavity, while the longer portion is configured with an insulating portion loaded with terminals without any metallic shell outside thereof.

6. The electrical connector as claimed in claim 5, wherein said long mating portion is wider than the short mating portion in a lateral direction perpendicular to the lengthwise direction and the mating direction.

7. The electrical connector as claimed in claim 6, further including a pair of guiding posts, of which one is located intimately on an exterior lengthwise end of the long mating portion in the lengthwise direction, and the other is located adjacent while spaced from an exterior lengthwise end of the short mating portion with a gap.

8. The electrical connector as claimed in claim 7, wherein said gap is essentially equal to another gap between the long mating portion and the short mating portion.

9. The electrical connector as claimed in claim 7, where the guiding post intimately located on the exterior lengthwise end of the long mating portion, is unitarily formed with the long mating portion.

* * * * *